US009389045B2

(12) United States Patent
Reichert et al.

(10) Patent No.: US 9,389,045 B2
(45) Date of Patent: Jul. 12, 2016

(54) AIMING DEVICE FOR GUNS

(71) Applicants: Abraham Reichert, Modiin (IL); Yaakov Sne, Tiberia (IL)

(72) Inventors: Abraham Reichert, Modiin (IL); Yaakov Sne, Tiberia (IL)

( * ) Notice: Subject to any disclaimer, the term of this patent is extended or adjusted under 35 U.S.C. 154(b) by 206 days.

(21) Appl. No.: 14/147,727

(22) Filed: Jan. 6, 2014

(65) Prior Publication Data

US 2015/0192389 A1 Jul. 9, 2015

(51) Int. Cl.
*F41G 1/38* (2006.01)
*F41G 1/30* (2006.01)

(52) U.S. Cl.
CPC .... *F41G 1/30* (2013.01); *F41G 1/38* (2013.01)

(58) Field of Classification Search
USPC ..... 42/130, 131; 356/247, 905; 359/362, 359/399, 428
See application file for complete search history.

(56) References Cited

U.S. PATENT DOCUMENTS 5,283,689 A * 2/1994 Carlough ..... F41G 1/38 356/247
5,850,700 A * 12/1998 Capson ..... F41G 1/467 33/265
2002/0078618 A1* 6/2002 Gaber ..... F41G 1/345 42/123
2007/0214701 A1* 9/2007 Grauslys ..... F41G 1/38 42/131

* cited by examiner

*Primary Examiner* — J. Woodrow Eldred
(74) *Attorney, Agent, or Firm* — Dekel Patent Ltd.; David Klein

(57) ABSTRACT

A sight for firearms based on a non-collimating optical system includes a reticle, a lens and a housing for holding the reticle to be centered with the optical axis of the lens, which is parallel to the barrel's center line of the firearm. The reticle is located axially apart of the lens back focal plane and projected toward the user's eye, such that the projected reticle appears centered to the lens barrel only when the user eye is on the same lens optical axis.

9 Claims, 14 Drawing Sheets

AIMING DEVICE FOR GUNS

FIELD OF THE INVENTION

The present invention is related to a non-collimated beam sight for use with short firearms, long firearms and other projectile launching devices. The invention is also related to a device that permits particularly quick and accurate adjustment of a sight of the fire arm, so as to allow excellent alignment of the sight with the aiming lime to the target.

BACKGROUND OF THE INVENTION

Sighting devices have been known for long time, most of which include a reticle or aiming point, the image of which is collimated with a collimating lens or a concave mirror and projected toward the eye of the viewer along parallel paths. Such collimating sights are advantageous for short range shooting where no magnification is needed, because the image of the reticle is projected out to an infinite point in space and is therefore always on target. Such sights also eliminate parallax with the result that the reticle image stays on the target even if the viewer moves his head. The main disadvantage of such configurations is a very small field of view, left for the shooter to detect the aiming point. It is even worth in case of a hand held pistol, where the hand movement make a very large bowing angle with respect to the shooter line of sight.

The collimating sights of the prior art are of two general types, both of which are designed for use with a generally short eye relief, and therefore, are usually mounted on the receiver portion of a rifle or a shotgun in close proximity to the eye of the shooter. The first general type of collimator sight of the prior art is disclosed in U.S. Pat. No. 1,442,015, issued in 1919 to E. D. Tillyer. This type of sight includes a collimated reticle within a tube about one to two inches in diameter, with the front end of the tube being opaque. As a result, the sight blocks most, or all, of the target from the field of view of the sighting eye of the shooter, and the sight must be used while both eyes of the shooter are open. Thus, the shooter sees the reticle of the sight with one eye and the target with the other eye and must rely on his own binocular ability to superimpose the two images. When a person uses a sight of this type where one eye looks at the reticle and the other eye looks at the field, the phenomenon of exophoria (the deviation of the visual axis of one eye away from that of the other eye in the absence of visual fusional stimuli) tends to frustrate the effort by causing the reticle image to drift over the field image, or to disappear altogether. Exophoria is a latent inability of one eye to attain binocular vision with the other eye because of imbalance of the extrinsic eye muscles, whereby the visual axes tend outward toward the temple. Thus, the first general type of collimated sights are difficult (if not impossible) to use, except for very quick snap shooting.

However, these sights are collimated and from their nature, when the user rotates his hand with the pistol and the sight on it, in a small angle, the reticule will disappear. The angle from which the shooter can still see the reticle is known to be the Maximum Noticeable Angle (MNA) of the sight.

Firearms, particularly hand-held fire arms are conventionally aimed by using a sight installed on the firearm and pointing the sight to the target point. By "target" is meant the object or person that the shooter intends to hit, and by "target point" is meant the point of the target at which the shooter aims the projectile.

Generally the projectiles may hit any point within an area about the target point. When the sight is aligned, it defines an aim line, and when said aim line passes through the shooter's aiming eye, the axis of the fire arm barrel should be substantially directed to the target point.

The accuracy of hand-held guns greatly depends on the relative orientation between the aiming line of the shooter's eye and the central axis of the gun's barrel. Since the aiming line coincides with the shooter's eye and with the target, in order to hit the target accurately, the aiming line and the central axis of the gun's barrel must be parallel. Otherwise, the bullet may deflect from the target's center.

Since any sight is mounted on top of the gun's slide, in most cases it is not perfectly aligned due to manufacturing and assembly tolerances. Therefore, it should contain an alignment mechanism, which can adjust its orientation with respect to the slide. Generally, the existing mechanisms are complex and expensive due to several alignment mechanical parts needed. Another problem arises when the shooter views the optical indication that is displayed when the sight is aligned. In many cases, the optical indication is an image of an optical fiber, which collects and transmits light to its proximal end (closer to the shooter's eye) and displays an illuminated dot. However, sometimes this dot is not sufficiently large and therefore, it is more difficult to the shooter to have a clear indication when exactly to shoot.

It is therefore, an object of this invention to provide a non-collimating sight for use with a firearm, or the like, which can be used by a shooter with either one eye or both eyes open.

It is a further object of this invention to provide a sight which is sufficiently small, so as not to obscure the target when the sight is used with only one eye of the shooter open thus making it possible to shoot with one eye or two.

It is still another object of this invention to provide a much shorter sight compare to the same reticle size, as in the prior art.

It is yet another object of this invention to provide a sight of the character described which is durable, inexpensive to manufacture, of simple construction, and yet reliable for short range shooting.

It is therefore needed to provide a simpler and more efficient mechanism, which includes only few moving parts. This is an additional object of the present invention—to provide such mechanism that is simple and that can be easily adjusted to obtain the desired alignment.

A further object is to provide a sight with a simple and reliable mechanism that allows a shooter to adjust the size of the image displayed by the optical fiber.

Other purposes and advantages of the invention will appear as the description proceeds.

SUMMARY OF THE INVENTION

The non-collimating sight of this invention is adapted so as to be usable by a shooter with either one eye or both eyes open, and is preferred to be used at a distance of from about 3 to about 4 feet from the eye of the shooter. The sight is sufficiently small as its footprint size over the target, so as not to obscure the target even when only one eye is used by the shooter to sight in on the target. Thus, the sight of this invention has the advantages of having a large MNA while keeping high accuracy for bore sighting.

To understand the nature of this invention, the meaning of the Maximum Noticeable Angle—MNA will be explained first. In general, the MNA is the maximum angle around a line of sight within which the shooter can see the reticule. The MNA is based on two angles. The first one is the angle which the shooter sees the angle with one eye without moving his head or hand—Instantaneous Field Of View—IFOV and the other angle is that related to the structure of the sight itself—Total Field Of View—TFOV. In more details, this angle—the TFOV depends on the reticle size and location in respect to the lens, the lens diameter, and the system magnification. The sum of the IFOV and the TFOV is the MNA.

The present invention is directed to a sight for firearms based on a non-collimating optical system, which comprises:

a) a reticle;

b) a lens; and c) a housing for holding the reticle to be centered with the optical axis of the lens, which is parallel to the barrel's center line of the firearm, wherein the reticle is located axially apart of the lens back focal plane and being projected toward the user's eye, such that the projected reticle appears centered to the lens barrel only when the user eye is on the same lens optical axis.

The distance of the reticle along the lens optical axis may be longer or smaller than the back focal length of the lens.

The reticle may be a light emitting diode or the end of a florescent optical fiber.

The lens may be a thick lens having a thickness which is larger or smaller than the side lens back focal length.

The sight may comprise:

a) a lens with thickness of grater or smaller than its back focal length, the lens having at least one outer surface with optical power;

b) a florescentic optical fiber attached to the distal surface of the lens, the proximal end of which is being projected by the lens, to form an image to be seen by the shooter, and located at the opposite side of the outer surface of the lens; and c) a housing for holding the florescentic fiber to coincide with the optical axis of the lens, which is parallel to the central axis of the barrel of the firearm, wherein the florescentic fiber is located axially apart of the lens back focal plain and being projected toward the user's eye, such that the projected florescentic fiber appears centered with the lens only when the user's eye is aligned with the same lens optical axis.

The lens may be a thick solid lens made of injection molded plastic material and may include a bore in its distal side opposite to the shooter. The bore has a diameter which is being adapted to receive the optical florescent fiber.

The optical florescent fiber may be embedded into the injection molded lens, to thereby form a single part. The injection molded lens may include a mounting projection, to be attached to the firearm and an opaque layer for covering a portion of the exterior surfaces of the injection molded lens.

The present invention is also directed to an optical aiming device for presenting a clear and distinctive image to a shooter with a controlled size and compensation capability, which comprises:

a) a housing that is mounted to the slide of the firearm;

b) a rotatable lid (which may be cylindrical) terminating the distal end of the housing, the rotatable lid having an external part with a similar diameter as the tubular housing that gathers light and an internal cylindrical part that is inserted into the distal end of the tubular housing, wherein the internal cylindrical part has smooth external face that is adjacent to the internal face of the tubular housing and both faces have a matching circumferential groove, into which a mating ring is inserted, so as to keep the rotatable lid attached to the tubular housing, and the internal cylindrical part has threaded internal face to receive a mating screw;

c) a mating screw, which has a bore with diameter similar to the diameter of an optical fiber along its central axis, the mating screw is screwed into the threaded face, while its head has a projection that enters a mating groove along the internal face of the tubular housing;

d) an optical fiber that is inserted into the bore and fixed to the screw, such that its distal end extends outwardly into the cavity formed by the internal face of the rotatable, so as to gather light;

e) a sphere with a bore slightly larger than the diameter of the optical fiber, such that the bore coincides with the central axis of the tubular housing and the opposing end of the optical fiber penetrates the bore, is free to move along the bore, and extends outwardly from the sphere, while coinciding all the time with the central axis of the tubular housing, wherein the sphere has a groove that mates a corresponding opening in the wall of the tubular housing, for receiving a mating lever for rotating the sphere in any desired direction;

f) a lens at the proximal end of the tubular housing for receiving an image of the optical fiber and for projecting the image to a point which is closer to the shooter's eye and coincides with the aiming line, to form an illuminated dot with a controllable diameter, depending on the length of the optical fiber that extends out of the sphere towards the shooter's eye, wherein when the rotatable lid rotates, the screw moves linearly along the aiming line, while the proximal end of the optical fiber extends more or less outwardly from the sphere.

Whenever the sphere is rotated vertically, the fiber is twisted such that its proximal end deflects from the central axis of the tubular housing in a direction that compensates for misalignment of the aiming device as desired.

The tubular housing may be mounted to the slide of the firearm by a dovetail joint. The groove may be in the form of a semi-circle, into which a mating O-ring is inserted.

These and other objects and advantages of the sighting device of this invention will become more readily apparent from the following detailed disclosure of several preferred embodiments thereof along with the accompanying drawings

DESCRIPTION OF EMBODIMENTS

Figure 1A:
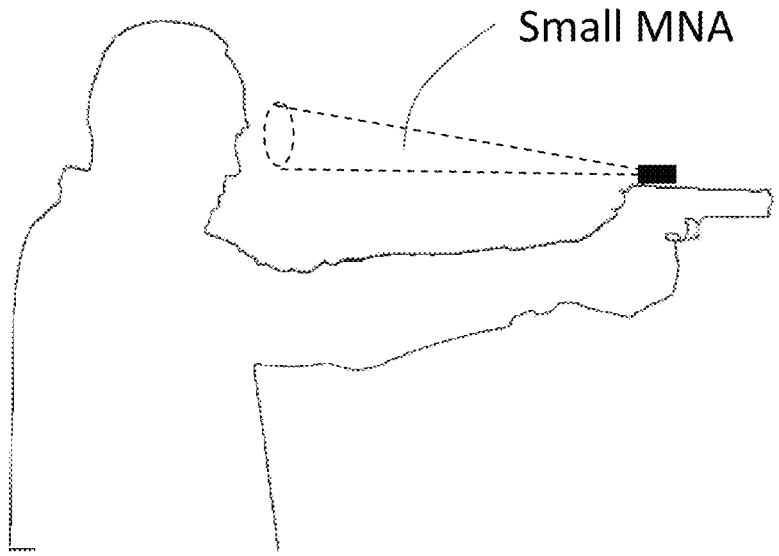
FIGS. 1A and 1B show a visual illustration of the term Maximum Noticeable Angle (MNA)
Figure 1B:
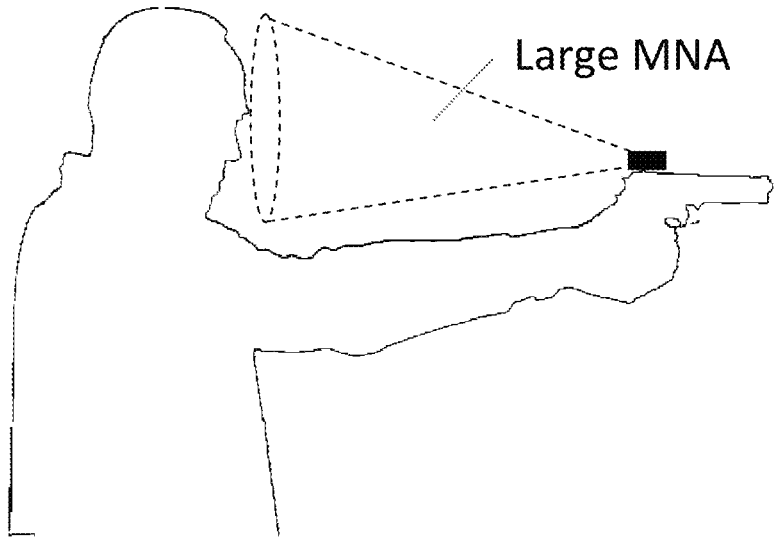

In FIGS. 1A and 1B one can see the meaning of the Maximum Noticeable Angle—MNA. FIG. 1A shows a shooter using a small MNA sight and FIG. 1B shows the shooter using a large MNA sight. Its easy to understand that in case the shooter have a larger MNA, its easier for him to see the reticule and rapidly aim to the target, while when the MNA is small, it will take him more time just to find the reticule in the reign of interest field of view, and just then to aim his weapon toward the target.

Figure 2:
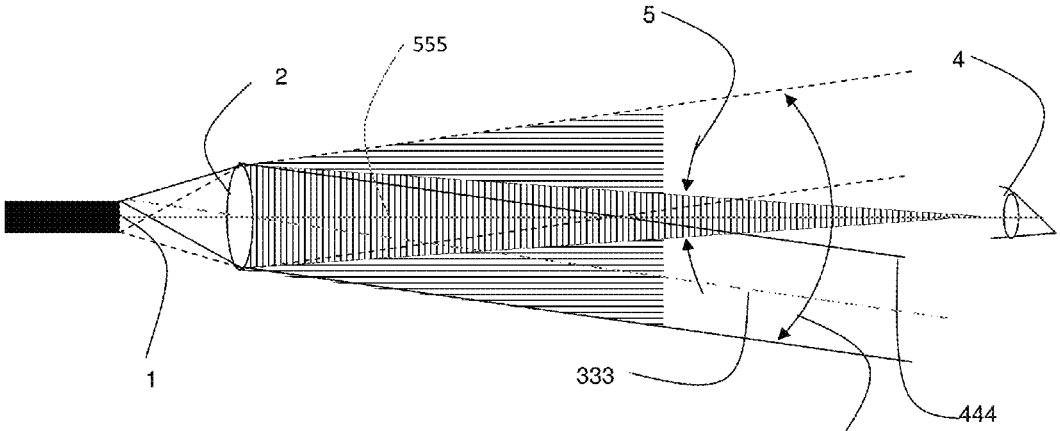
FIG. 2 is a schematic drawing of a prior art collimated sight.

FIG. 2 is a schematic drawing of a prior art collimated sight describing the small MNA. The reticle 1 is placed at the focal plane of lens 2, and thus the chief ray 333 and the marginal ray 444 have the same angle with respect to the optical axis 555 after being refracted by the lens 2. The magnification of the lens is very high so that the rays coming out of the sight have a small TFOV 3. Normally, the TFOV is the Arc-Tangent of the ratio between the reticle size/Lens focal length. In most of the optical sights, the TFOV is about 1 deg or even smaller. The IFOV 5 is the angle of a cone with its base laying on the lens diameter 2 and its heights equivalent to the distance between the shooters eye 4 and the lens 2. In this case, the MNA is given by:

$$MNA=TFOV+IFOV$$

In most of the collimating sights, the TFOV is smaller than the IFOV, otherwise, the projected reticle will be larger than the lens diameter and that will cause losses of accuracy of bore-sighting. Since the MNA is small, it will make the shooter more time to find the projected sight on the target.

Figure 3:
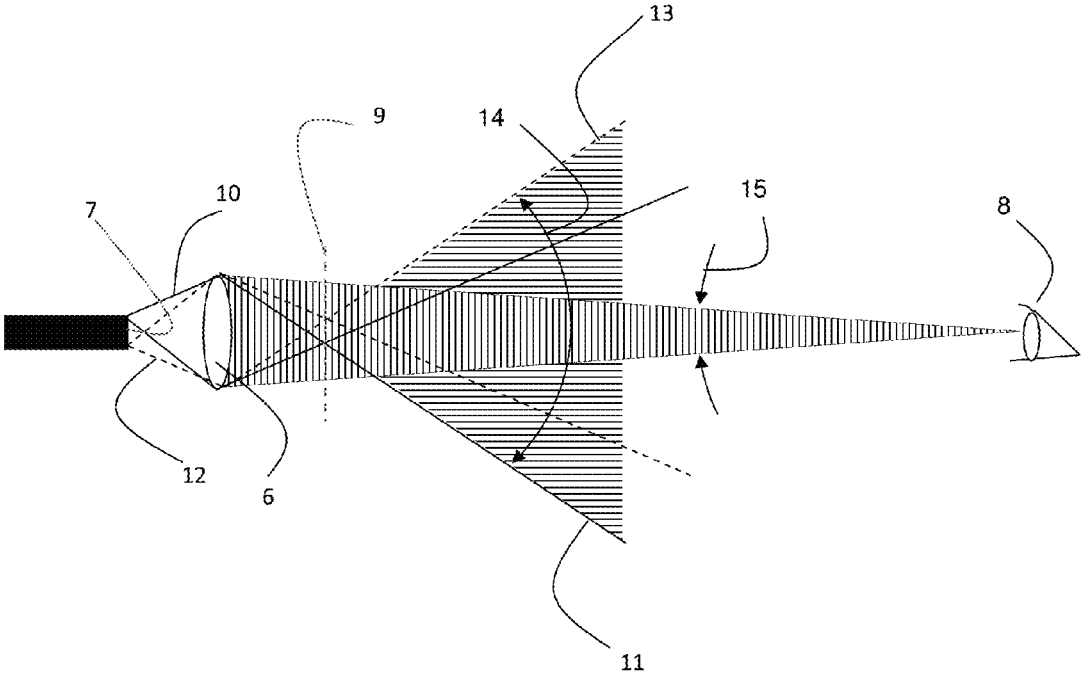
FIG. 3 describes a schematic explanation for the MNA of a preferred embodiment.

FIG. 3 describes a schematic explanation for the MNA of a preferred embodiment. A lens 6 relays the reticule 7 toward the shooter's eye 8 at the image plane 9. A marginal ray 10 exits the upper side of the reticle and is refracted by the lens 6 as ray 11. The same applies for ray 12 which is refracted by the lens 6 as ray 13. The angle between ray 11 and 13 is the TFOV 14. If the size of the reticle 7 is much smaller with respect to the focal length of lens 6, it can be assumed that angle 14 is given by:

$$\text{Angle } 14=2\times\text{Arcsin}(NA_{Image})$$

$NA_{Image}$ is the Sine of the half angle of the cone of light at the image space.

The NA in the image space is the NA in the object space multiplied by the magnification M.

$$NA_{Image}=M\times NA_{Object}$$

So that the TFOV is given by:

$$TFOV=M\times 2\text{Arcsin}(NA_{Object})$$

And the MNA is:

$$MNA=\times 2\text{Arcsin}(NA_{Object})+IFOV$$

Since the magnification of this embodiment is much smaller than the one in the collimating sight, it defiantly enlarges the TFOV of the sight. The IFOV 15 stays the same as for the collimated sight that makes the MNA of this embodiment much larger than the one describes in the prior art.

Figure 4:
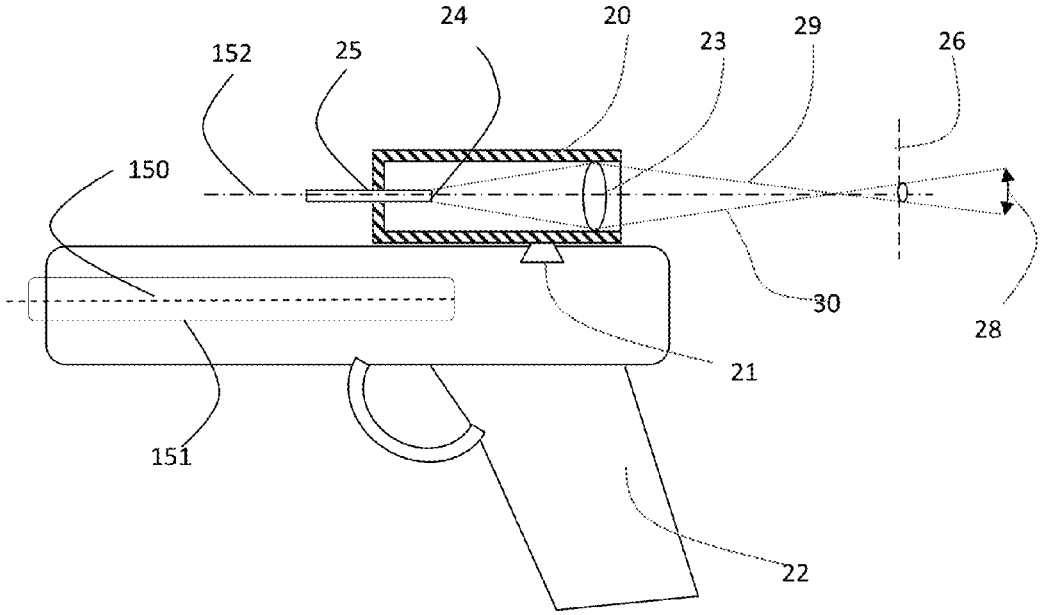
FIG. 4 is a cross sectional view of a preferred embodiment of a non-collimating sight.

FIG. 4 shows a cross section of the preferred embodiment of a non-collimating sight. The sight body 20 is attached by a dove-tail 21 to the slide of gun 22. The sight body 20 comprises a lens 23, the optical axis 152 of which is parallel to the gun's barrel 150 "center line" 151, and a reticle 24, which is centered to coincide with the lens optical axis 152. The lens 23 projects a real magnified image of the reticle 24, to the image plane 26 located between the lens 23 and the shooter's eye 27. In this case, the reticle 24 is the end of a florescent fiber 25. The TFOV 28 of this configuration is the angle between the two marginal rays 29 and 30. Since the magnification is much smaller than in the one of the prior art, its mean that the MNA is much larger.

Figure 5A:
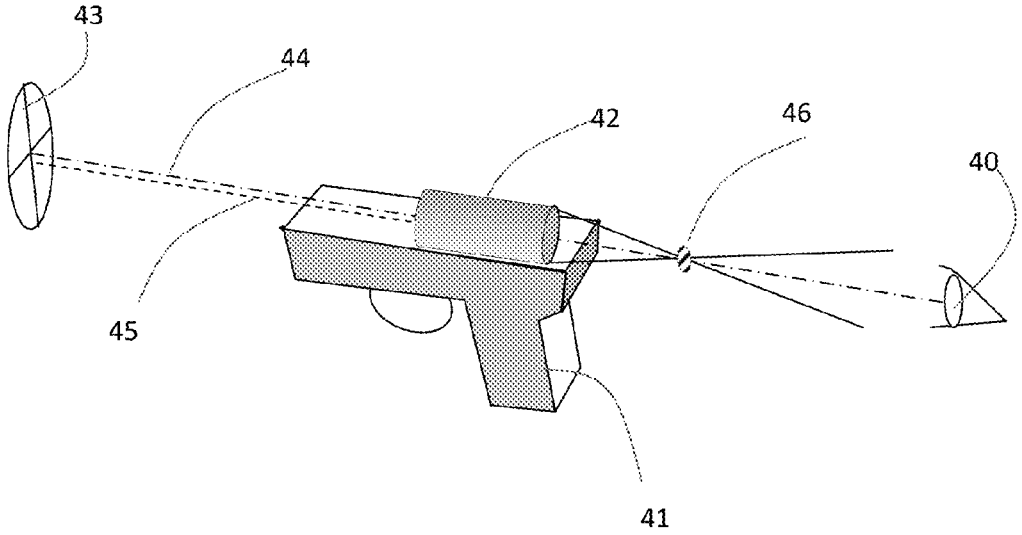
FIGS. 5A and B show the whole scenario of a preferred embodiment in bore-sight position, and the silhouette of what the shooter will see.

FIG. 5A shows the whole scenario of the preferred embodiment of shooter's eye 40, the gun 41, the sight 42 and the target 43, so that the line of sight 44 to the target and the gun's line of sight 45 are parallel.

Figure 5B:
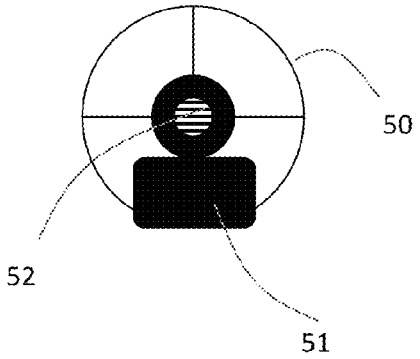

FIG. 5B shows the silhouette of what the shooter will see when the line of sight will be aligned with the bore sight. He will be able to see the target 50, which is placed far from him, the silhouette of the gun and the sight 51 and a projected reticle 52 located between the sight and the shooter's eye and being centered to the sight lens.

Figure 6A:
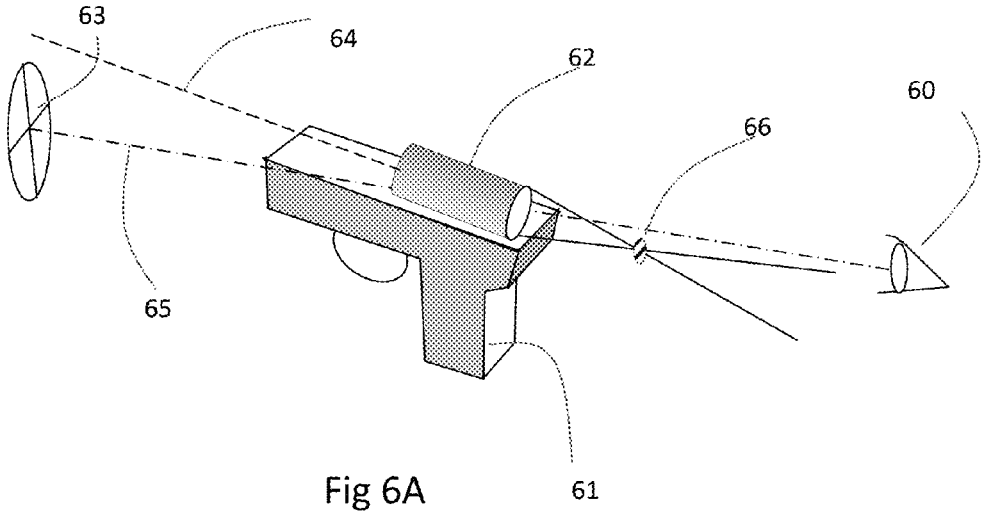
FIGS. 6A and 6B show the whole scenario of a preferred embodiment out of bore-sight position, and the silhouette of what the shooter will see.

FIG. 6A show the whole scenario of the gun 61 and the sight 62 when they are not in bore sight with the shooter's eye 60 and the target. In this case, the line of sight 65 to the target 63 is not parallel to the gun line of sight 64, so the projected reticle 66 will not be centered on the target 63.

Figure 6B:
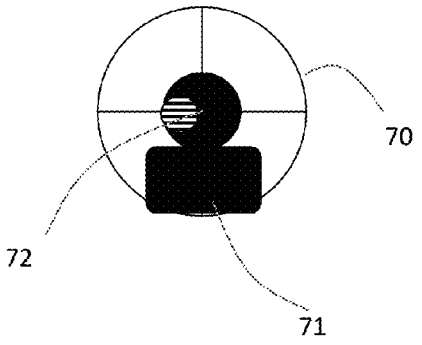

FIG. 6B shows the silhouette of what the shooter will see when the gun and the sight will not be in bore sight with the target. In this case, the target 70 is placed far from him, the silhouette of the gun and the sight 71 and the projected reticle 72 located between the sight and the shooter's eye and not being centered to the sight.

Figure 7:
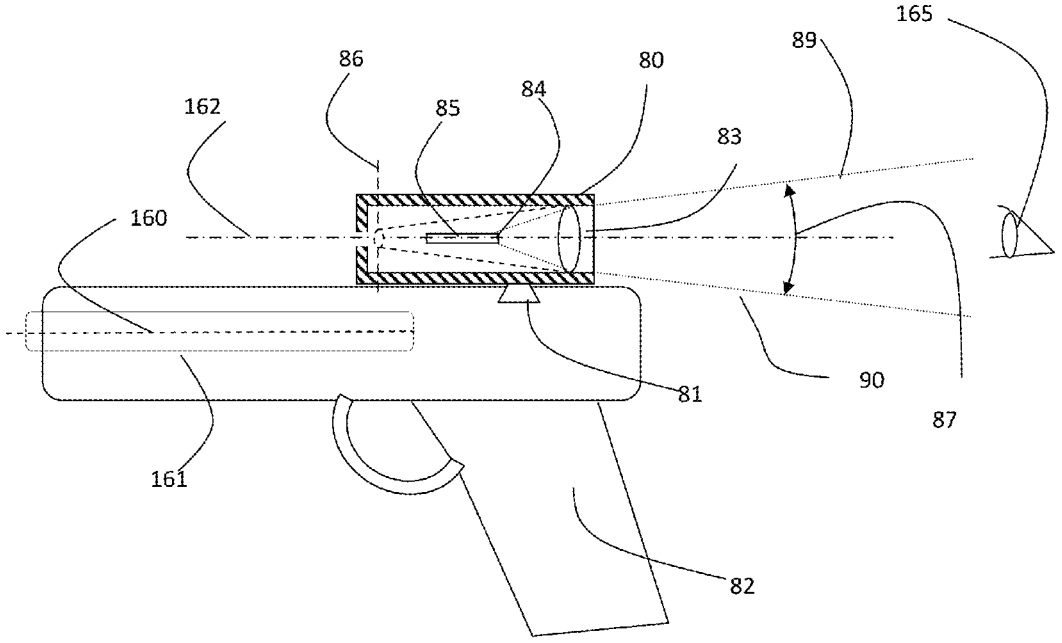
FIG. 7 is a cross sectional view of a second preferred embodiment.

FIG. 7 shows a cross section of the second preferred embodiment of a non-collimating sight. The sight body 80 is attached by a dove-tail 81 to the gun 82. The sight body 80 comprises a lens 83, which its optical axis 162 is parallel to the gun's barrel 161 "center line" 152, and a reticle 84 is centered to the "lens optical axis" 162. The lens 83 projects a virtual and magnified image of the reticle 84, to an image plane 86 located at the same side of the reticle 84 side. In this case, the reticle 24 is the end of a florescent fiber 85. The TFOV 87 of this configuration is the angle between the two marginal rays 89 and 90. Since the magnification is much smaller than in the one of the prior art, its mean that the MNA is much larger.

Figure 8A:
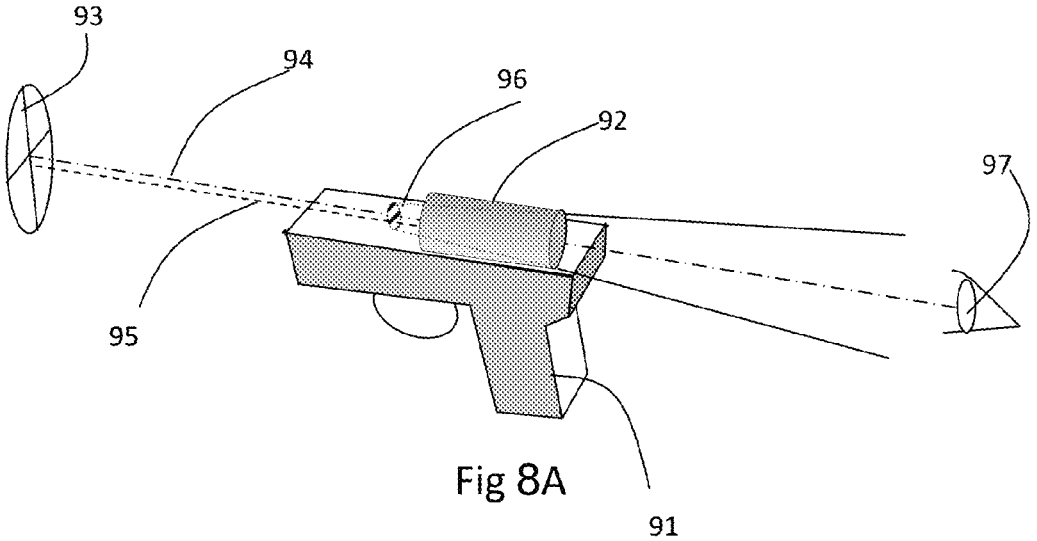
FIGS. 8A and 8B show the whole scenario of the second preferred embodiment in bore-sight position, and the silhouette of what the shooter will see.

FIG. 8A show the whole scenario of the second preferred embodiment of a shooter's eye 97, the gun 91, the sight 92 and the target 93, are all bore-sighted on line so that the "target line of sight" 94 and the "gun line of sight" 95 are parallel.

Figure 8B:
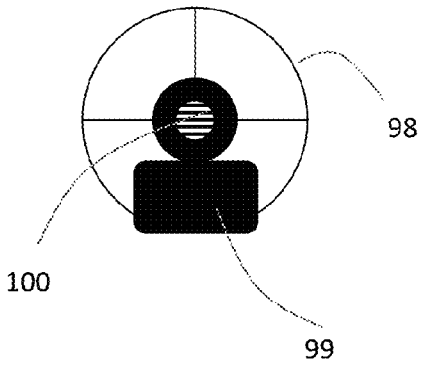

In FIG. 8B one can see the silhouette of the scenario as described in FIG. 8A. The shooter will see the silhouette of the gun and the sight 99 on the target 98 background while the projected reticle 100 will be centered to the sight's silhouette.

Figure 9A:
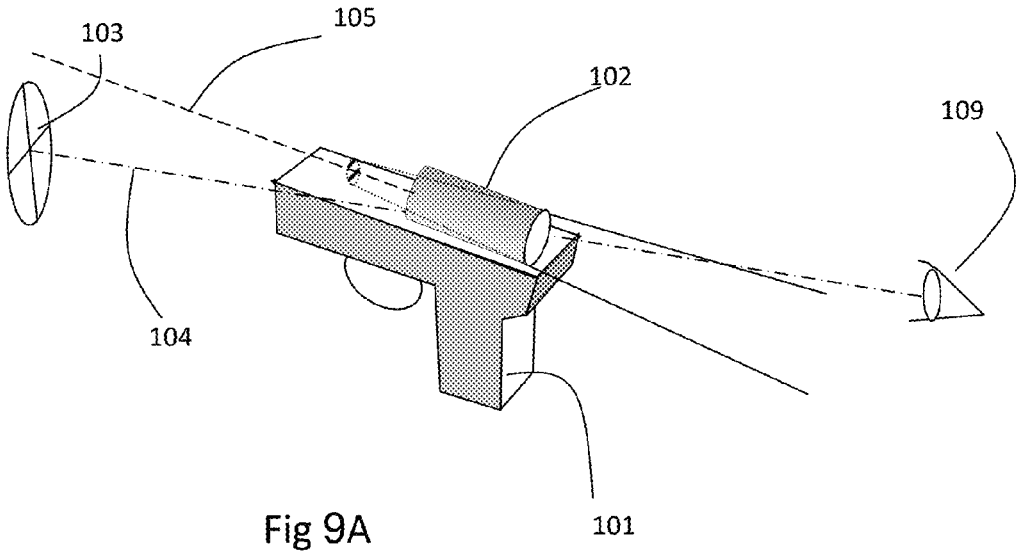
FIGS. 9A and 9B show the whole scenario of the second preferred embodiment out of bore-sight position and the silhouette of what the shooter will see.

FIG. 9A shows the whole scenario of the second preferred embodiment of a shooter's eye 109, the gun 101, the sight 102 and the target 103, are all not in bore-sighted so that the "target line of sight" 104 and the "gun line of sight" 105 are not being parallel.

Figure 9B:
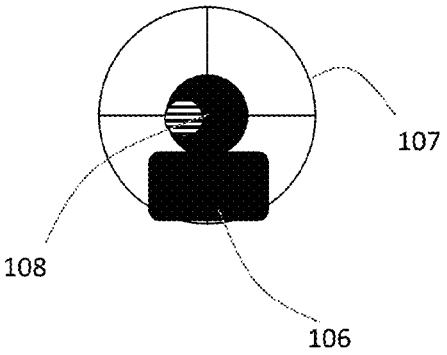

In FIG. 9B one can see the silhouette of the scenario as described in FIG. 9A. The shooter will see the silhouette of the gun and the sight 106 on the target 107 background, while the projected reticle 108 will not be centered to the sight's silhouette.

Figure 10:
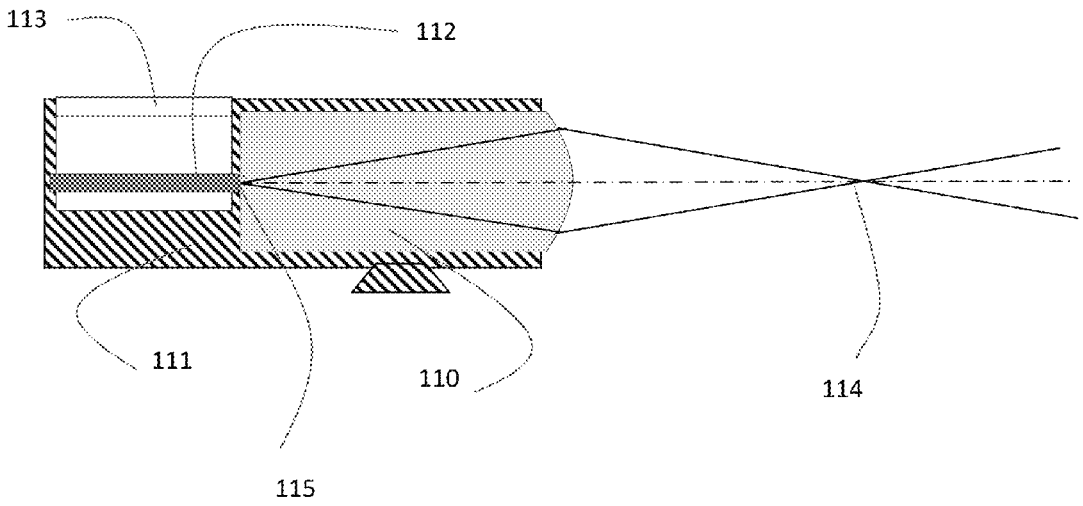
FIG. 10 describes another embodiment of the invention.

FIG. 10 describes another embodiment of the invention. In this figure one can see a the sight housing 111, containing a transparent cover 113, a thick lens 110 made of injection molded plastic material, a florescent optic fiber 112, where its proximal end 115 is being projected by the lens 110, to form an image 114 to be seen by the shooter.

Figure 11:
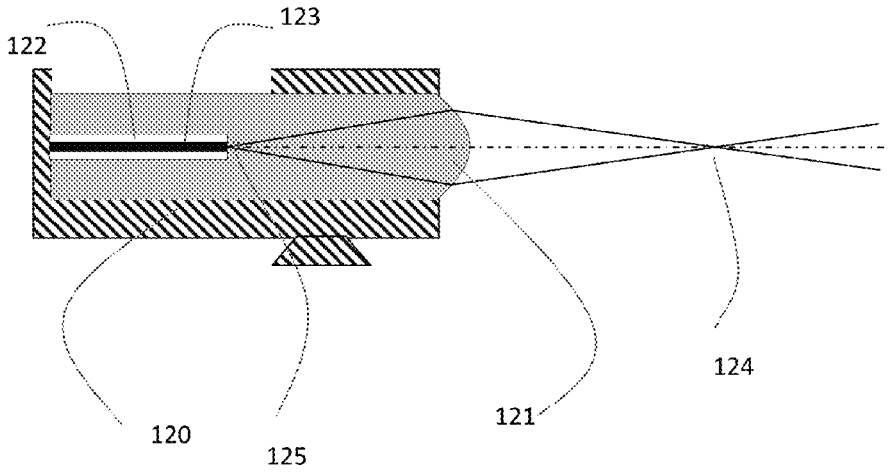
FIGS. 11-13 describe other embodiments that allow reducing the manufacturing cost of the sight.

FIG. 11 describes another embodiment that allows reducing the manufacturing cost of the sight. The sight is built of only 3 parts, the body 120, the injection molded lens 121 so that at the opposite side to the shooter, there is a bore 122 in such a diameter to allow inserting the florescent fiber optic 113.

Figure 12:
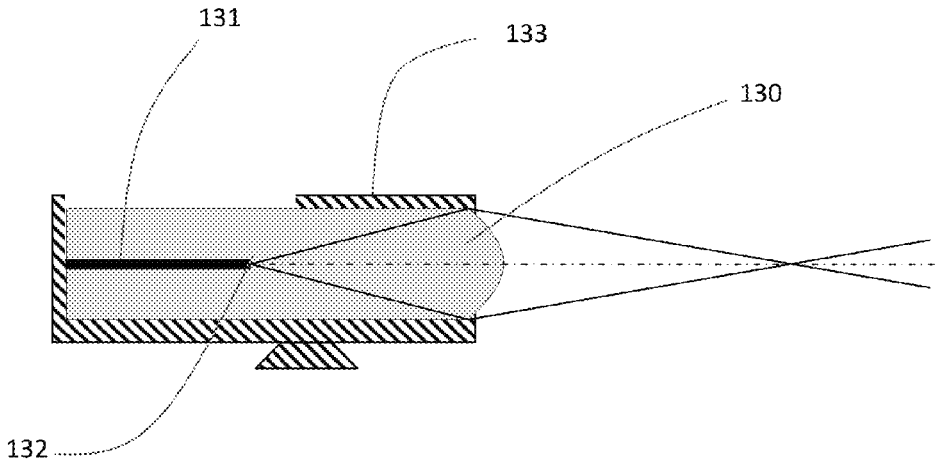

FIG. 12 describes another embodiment of the invention that allows reducing the manufacturing cost of the sight even more as describe in FIG. 11. In this embodiment, the sight can be build by only two parts, the body 133, and the lens 130. The lens 130 and the florescent fiber optic 131 are made as one part, using an injection molding technology.

Figure 13:
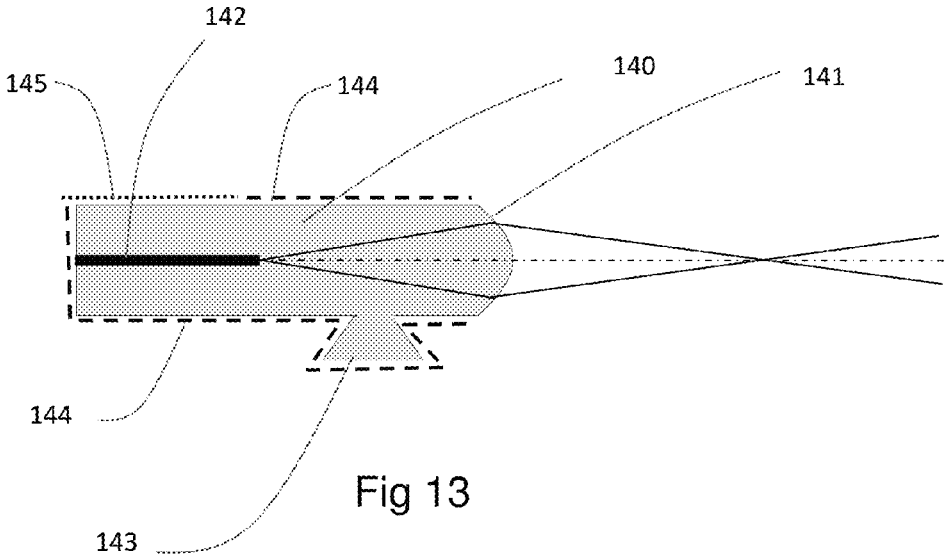

FIG. 13 describes another embodiment of the invention that allows reducing the manufacturing cost of the sight even more. In this embodiment, the sight can be build by only single transparent injection plastic element 140, which contains the lens front surface 141, the florescent fiber 141 a "dove tail"143 to connect the sight to the weapon. Since the material of the whole sight is transparent, some of the exterior surfaces 144 must be opaque, except for the front lens surface 141 and at least one zone 145 close to the florescent fiber 142, which should remain transparent.

Figure 14:
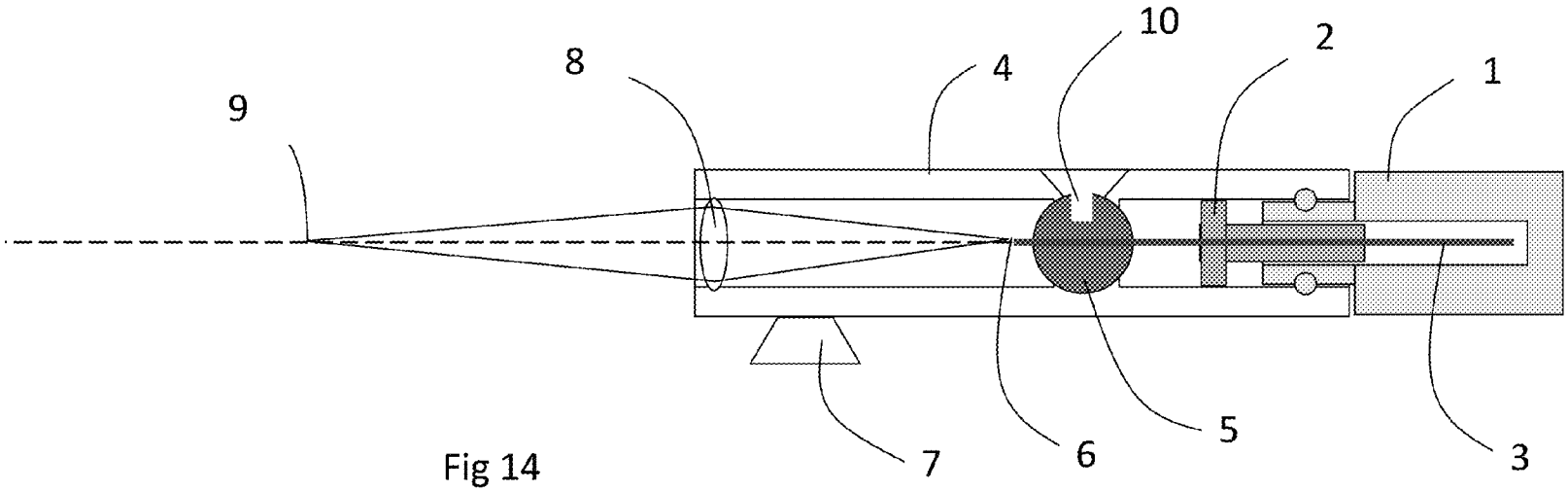
FIG. 14 illustrates a cross-sectional view of the proposed aiming device which includes an arrangement that is installed on the slide of a gun and allows presenting a clear and distinctive image to the shooter, at a controlled size that is optimal for him.

FIG. 14 illustrates a cross-sectional view of the proposed aiming device which includes an arrangement that is installed on the slide of a gun and allows presenting a clear and distinctive image to the shooter, at a controlled size that is optimal for him. The aiming device includes a tubular housing 4 that is mounted to the slide of the firearm by a "dovetail" joint 7. The distal end of the tubular housing 4 is terminated by a cylindrical rotatable lid 1 with an external cylindrical part (in a similar diameter as the tubular housing 4) that gathers light and an internal cylindrical part that is inserted into the distal end of the tubular housing 4. The internal cylindrical part has smooth external face that is adjacent to the internal face of the tubular housing 4. In addition, both faces have a matching circumferential groove in the form of a semi-circle, into which a mating O-ring is inserted, so as to keep the rotatable lid 1 attached to the tubular housing 4. The internal cylindrical part has threaded internal face to receive a mating screw 2.

The mating screw 2, which has a bore with diameter similar to the diameter of an optical fiber 3 along its central axis, is screwed into the threaded face while its head has a projection that enters a mating groove along the internal face of tubular housing 4. This projection prevents screw 2 from rotating. As a result, while rotatable lid 1 rotates, screw 2 moves linearly back and forth within tubular housing 4, depending on the rotation direction. Optical fiber 3 is inserted into the bore and fixed to screw 2 (e.g., by gluing it) such that its distal end extends outwardly into the cavity formed by the internal face of rotatable lid 1, so as to gather light. The opposing end of optical fiber 3 penetrates a sphere 5 with a bore slightly larger than its diameter, such that this bore coincides with the central axis of the tubular housing 4 and optical fiber 3 is free to move along this bore. The proximal end of optical fiber 3 extends outwardly from the sphere, while coinciding all the time with the central axis of tubular housing 4. Sphere 5 has a rectangular groove 10 that mates a corresponding opening in the wall of the tubular housing 4, so as to receive a mating lever for slightly rotating the sphere in any desired direction.

The optical concept is to include a lens 8 at the proximal end of tubular housing 4 that receives an image of an input object (in this example, optical fiber 3) at a point 6, which may be located at a distance from the lens 8, which may be longer or shorter that the focal length of the lens. This way, the image of the input object is projected to point 9, which is closer to the shooter's eye and coincides with the aiming line. In this situation, the gathered light will be projected by the optical fiber as an illuminated dot with a controllable diameter, depending on the length of the optical fiber that extends out of sphere 5 towards the shooter's eye.

Figure 15:
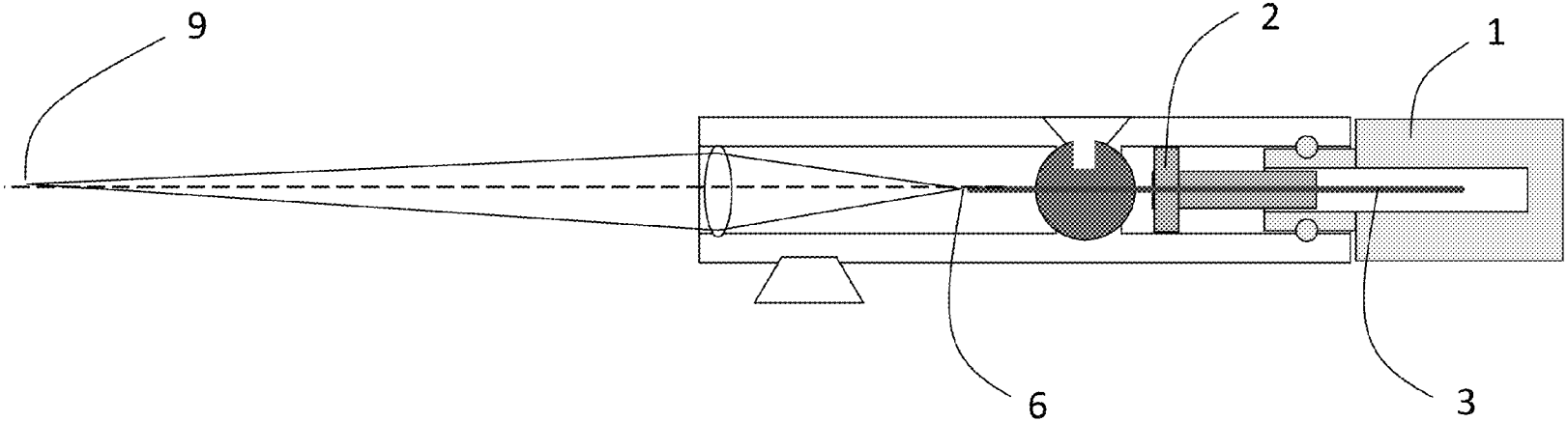
FIGS. 15-19 illustrate several cross-sectional views of the proposed aiming device shown in FIG. 14.

FIG. 15 illustrates a cross-sectional view of the proposed aiming device shown in FIG. 14 above, after the shooter rotates the rotatable lid 1 in a direction that causes screw 3 to move linearly towards the shooter's eye. As a result, the proximal end of optical fiber 3 extends more outwardly from the sphere, while coinciding all the time with the central axis of tubular housing 4. The image (dot) is now projected by lens 8 to a point 9, which closer to the shooter's eye and therefore, the shooter sees a magnified dot. If the shooter wishes to see less magnified dot, he should rotate the rotatable lid 1 in the opposite direction, so as to allow the proximal tip of optical fiber 3 to move towards the target and extends from sphere 5 less than before.

Figure 16:
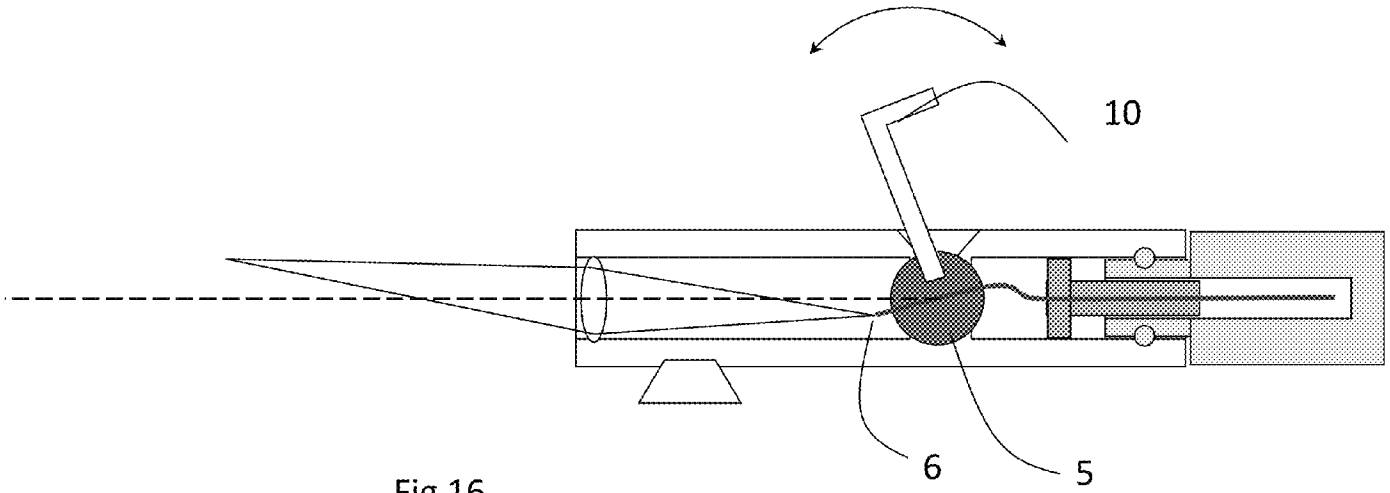

FIG. 16 illustrates a cross-sectional side view of the proposed aiming device shown in FIG. 14 above, after the shooter rotates the sphere 5 vertically in a counterclockwise direction. As a result, the fiber 3 is slightly twisted, such that its proximal end deflects downwardly from the central axis of tubular housing 4. This deflection compensates for misalignment of the aiming device upwardly as desired, without needing any mechanical adjustment of the mounting mechanism of the aiming device.

Figure 17:
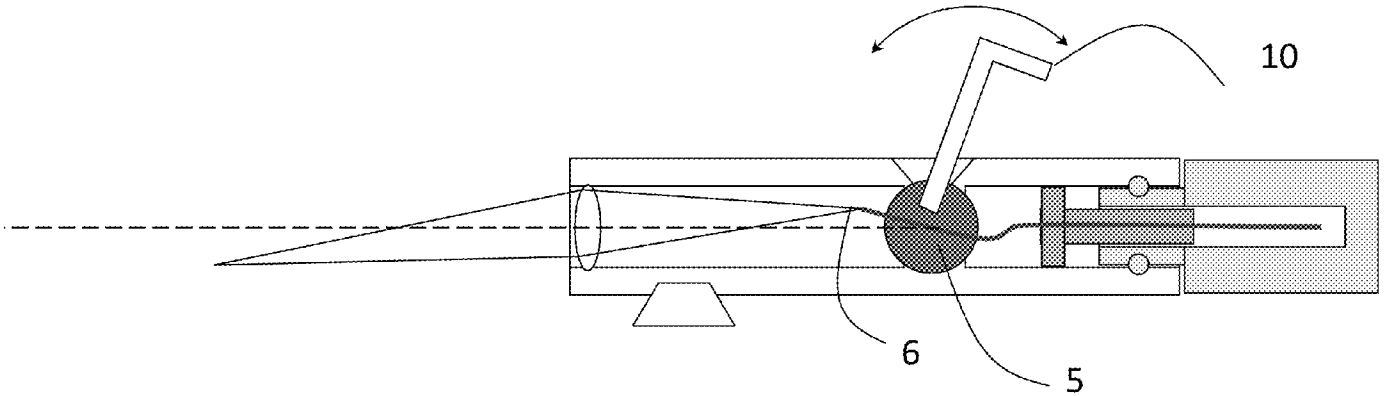

FIG. 17 illustrates a cross-sectional side view of the proposed aiming device shown in FIG. 14 above, after the shooter rotates the sphere 5 vertically in a clockwise direction. As a result, the fiber 3 is slightly twisted, such that its proximal end deflects upwardly from the central axis of tubular housing 4. This deflection compensates for misalignment of the aiming device downwardly as desired, without needing any mechanical adjustment of the mounting mechanism of the aiming device.

Figure 18:
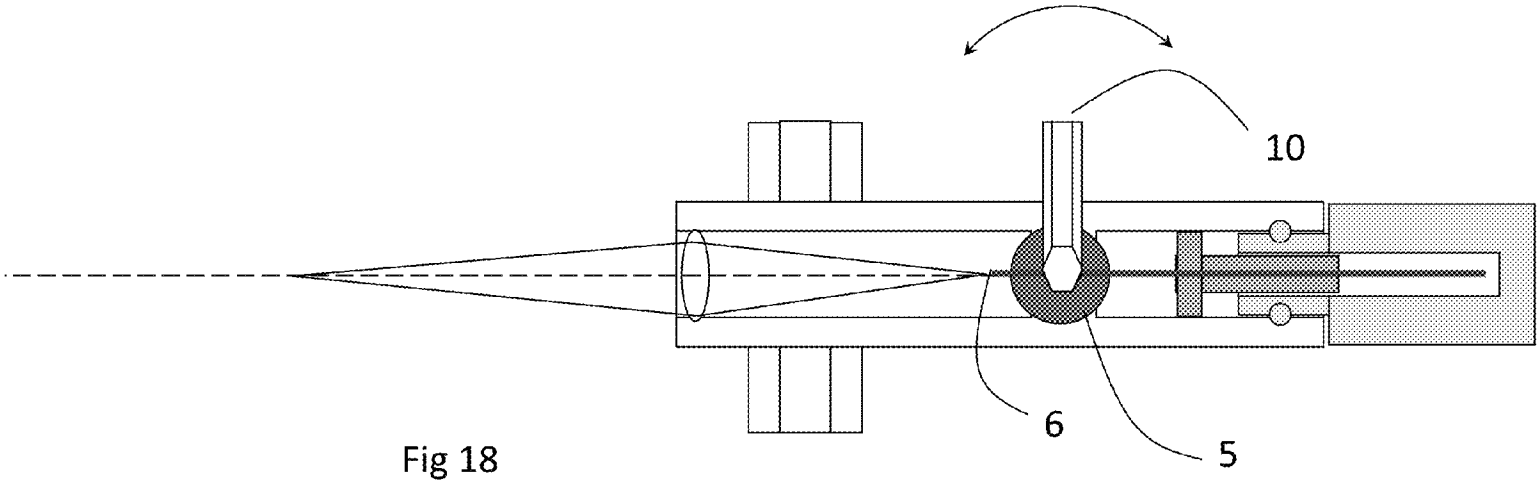

FIG. 18 illustrates a cross-sectional top view of the proposed aiming device shown in FIG. 14 above, when the aiming device and sphere 5 are horizontally aligned with the aiming line to the target. In this case, the lever position keeps fiber 3 linear, while it's proximal end is aligned with the central axis of tubular housing 4, such that the image of the proximal tip of optical fiber 3 is projected by lens 8 on the aiming line without deflection. If compensation is needed, the shooter can rotate the lever in the appropriate direction.

Figure 19:
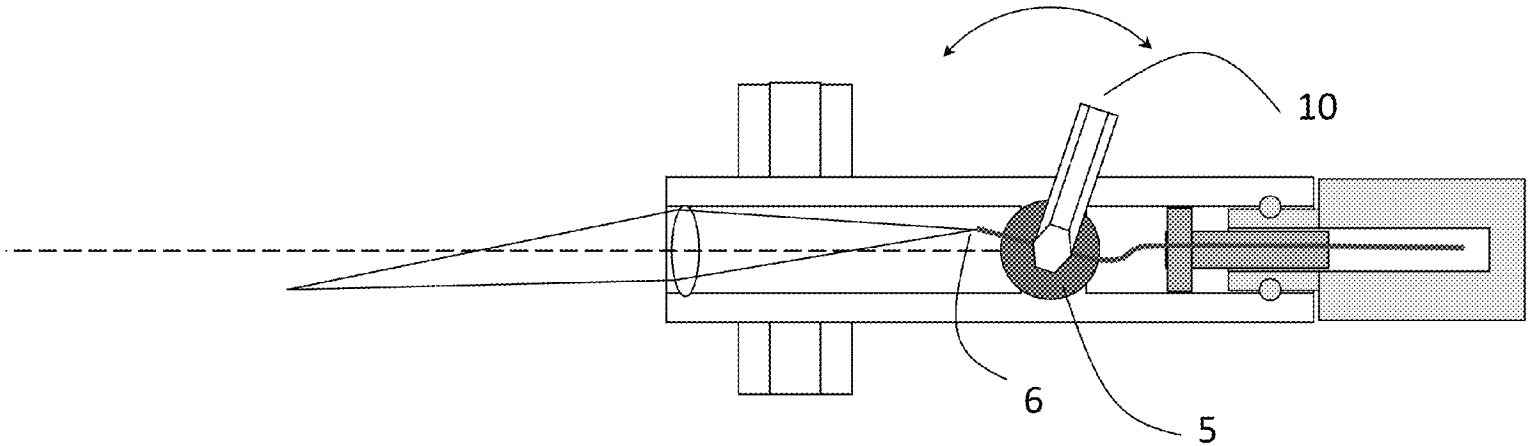

FIG. 19 illustrates a cross-sectional top view of the proposed aiming device shown in FIG. 14 above, after the shooter rotates the sphere 5 horizontally in a clockwise direction. As a result, the fiber 3 is slightly twisted, such that its proximal end deflects laterally (to the left) from the central axis of tubular housing 4. This deflection compensates for misalignment of the aiming device laterally (to the right) as desired, without needing any mechanical adjustment of the mounting mechanism of the aiming device.

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention.

The invention claimed is:

1. A sight for a firearm comprising:

a) a lens having a back focal length, an optical axis and an outer surface with optical power;

b) a fluorescent optical fiber attached to a distal surface of said lens, a proximal end of said fiber being projected by said lens to form an image to be seen by a shooter and located at an opposite side of said outer surface of said lens;

c) a housing for holding said fluorescent fiber to coincide with the optical axis of said lens, which is parallel to a central axis of a barrel of a firearm, wherein said fluorescent fiber is located axially apart of back focal plane of said lens and said fluorescent fiber is projected toward a user's eye, such that said fluorescent fiber appears centered with respect to said lens only when said user's eye is aligned with the optical axis of said lens;

and wherein said lens comprises a mounting projection attachable to the firearm and an opaque layer for covering a portion of exterior surfaces of said lens.

2. A sight according to claim 1, wherein the lens is a thick solid lens made of injection molded plastic material.

3. A sight according to claim 2, wherein the injection molded lens includes a bore in its distal side opposite to the shooter, said bore having a diameter which is being adapted to receive the optical florescent fiber.

4. A sight according to claim 2, wherein the optical fluorescent fiber is embedded into the injection molded lens, to thereby form a single part.

5. An optical aiming device for presenting a clear and distinctive image to a shooter with a controlled size and compensation capability, comprising:

a) a tubular housing that is mounted to a slide of a firearm;

b) a rotatable lid located at a distal end of said tubular housing, said rotatable lid having an external part that gathers light and an internal cylindrical part that is inserted into the distal end of said tubular housing, wherein said internal cylindrical part has a smooth external surface that is adjacent to an internal surface of said tubular housing and wherein said external and said internal surfaces are formed with circumferential grooves into which a mating ring is inserted, and said internal cylindrical part has a threaded internal surface;

c) a mating screw, which is formed with a bore and which is screwed into the threaded surface of said internal cylindrical part, and wherein a head of said mating screw has a projection that enters a mating groove formed along the internal surface of said tubular housing;

d) an optical fiber that is inserted into the bore and fixed to said screw, such that a distal end of said optical fiber extends outwardly into a cavity formed by an internal surface of said rotatable lid so as to gather light;

e) a sphere formed with a bore that coincides with a central axis of the tubular housing, wherein a proximal end of said optical fiber penetrates said bore and said optical fiber is free to move along said bore and extend outwardly from the sphere, while constantly coinciding with the central axis of said tubular housing, wherein said sphere has a groove that mates with a corresponding opening in a wall of said tubular housing for receiving a mating lever for rotating the sphere in any desired direction;

f) a lens at a proximal end of said tubular housing for receiving an image of said optical fiber and for projecting said image to a point which is closer to a shooter's eye coinciding with an aiming line to form an illuminated dot with a controllable diameter, depending on a length of the optical fiber that extends out of said sphere towards the shooter's eye, wherein when the rotatable lid rotates, said screw moves linearly along the aiming line, while the proximal end of said optical fiber extends more or less outwardly from the sphere.

6. An optical aiming device according to claim 5, wherein whenever the sphere is rotated vertically, the fiber is twisted such that its proximal end deflects from the central axis of the tubular housing in a direction that compensates for misalignment of the aiming device as desired.

7. An optical aiming device according to claim 5, wherein the tubular housing is mounted to the slide of the firearm by a dovetail joint.

8. An optical aiming device according to claim 5, wherein the rotatable lid is cylindrical.

9. An optical aiming device according to claim 5, wherein the groove is in the form of a semi-circle into which a mating O-ring is inserted.

* * * * *